US005373600A

United States Patent [19]

Stojanovski et al.

[11] Patent Number: 5,373,600

[45] Date of Patent: Dec. 20, 1994

[54] GRILL SCRAPER AND CLEANER

[76] Inventors: Stojan Stojanovski, 1950 Birchwood, Troy, Mich. 48084; Mitre Bosilkovski, 4481 Timberlake, Shelby Township, Macomb County, Mich. 48315

[21] Appl. No.: 149,376

[22] Filed: Nov. 9, 1993

[51] Int. Cl.[5] ..... A47L 17/00

[52] U.S. Cl. ..... 15/111; 15/236.05; 15/236.07; 15/236.09

[58] Field of Search ..... 15/111, 236.05, 236.07, 15/236.09

[56] References Cited

U.S. PATENT DOCUMENTS

| | | | |
|---|---|---|---|
| 2,747,911 | 5/1956 | Kuever | 15/236.05 X |
| 2,824,323 | 2/1958 | Tos et al. | 15/105 |
| 3,307,212 | 3/1967 | MacInnes | 15/111 |
| 3,487,491 | 1/1970 | Dunn | 15/111 |
| 4,146,943 | 4/1979 | Wertheimer et al. | 15/111 |
| 4,286,349 | 9/1981 | Dugrenier | 15/111 |
| 4,365,380 | 12/1982 | Fassler | 15/111 |
| 4,910,827 | 3/1990 | Tandberg et al. | 15/236.06 |
| 4,958,403 | 9/1990 | Martin | 15/236.07 |

*Primary Examiner*—Chris K. Moore
*Attorney, Agent, or Firm*—Charles W. Chandler

[57] ABSTRACT

A combination scraper and wire brush for cleaning a barbecue grill comprises a channel-shaped holder attached to a handle. One side of the holder has a scraper wall with a series of openings which mate with the bars of the barbecue grill. The rear wall cooperates with the front wall to removably retain a wire brush having bristles disposed behind the openings in the scraper wall.

10 Claims, 2 Drawing Sheets

GRILL SCRAPER AND CLEANER

BACKGROUND OF THE INVENTION

This invention is related to cleaning tools for barbecue grills and the like having a plurality of spaced parallel bars, and more particularly to a tool having a scraper wall with openings for receiving the grill bars, and a brush with wire bristles carried immediately behind the scraper wall to both scrape and brush the grill bars in the same motion.

Typical outdoor barbecue grills are difficult to clean. A wire brush is usually employed for removing the burnt food particles. Sometimes a scraping device is employed to remove the food particles. Some devices for cleaning barbecue grills may be found in U.S. Pat. No. 4,910,827 which was issued Mar. 27, 1990 to William E. Tandberg and Leonard G. Tandberg for a "Barbecue Grill with Cleaning Bar"; U.S. Pat. No. 4,365,380 which was issued Dec. 28, 1982 to Fred G. Fassler for "Brush-like Cleaning Tool for Cleaning Grills and Other Structures having Elongate Rod-like Members"; U.S. Pat. No. 4,146,943 which was issued Apr. 3, 1979 to Donald J. Wertheimer and Ralph A. Holmes for "Grooved grill Cleaner"; U.S. Pat. No. 2,824,323 which was issued Feb. 25, 1958 to Oreste Tos and E. Louis DeMarco for a "Grill Scraper and Cleaner" and U.S. Pat. No. 3,487,491 which was issued Jan. 6, 1970 to John M. Dunn for "Brazier-Grill Cleaning Tool".

These patents indicate that it is commonly recognized that to adequately clean a Grill, it is necessary to use both a scraper and a brush. However, typically a tool used for scraping several bars at a time usually requires a separate motion by the user for brushing the finer particles of debris from the grill.

SUMMARY OF THE INVENTION

The broad purpose of the present invention is to provide a tool which will both scrape and brush the debris from a grill in a single stroke of the tool.

Another object of the invention is to provide a combination scraper and brush in which the brush is removably mounted in the scraper body.

Still further objects and advantages of the invention will become readily apparent to those skilled in the art to which the invention pertains upon reference to the following detailed description of the drawings.

DESCRIPTION OF THE DRAWINGS

The description refers to the accompanying drawings in which like reference characters refer to like parts throughout the several views, and in which.

Description of a Preferred Embodiment

Figure 2:
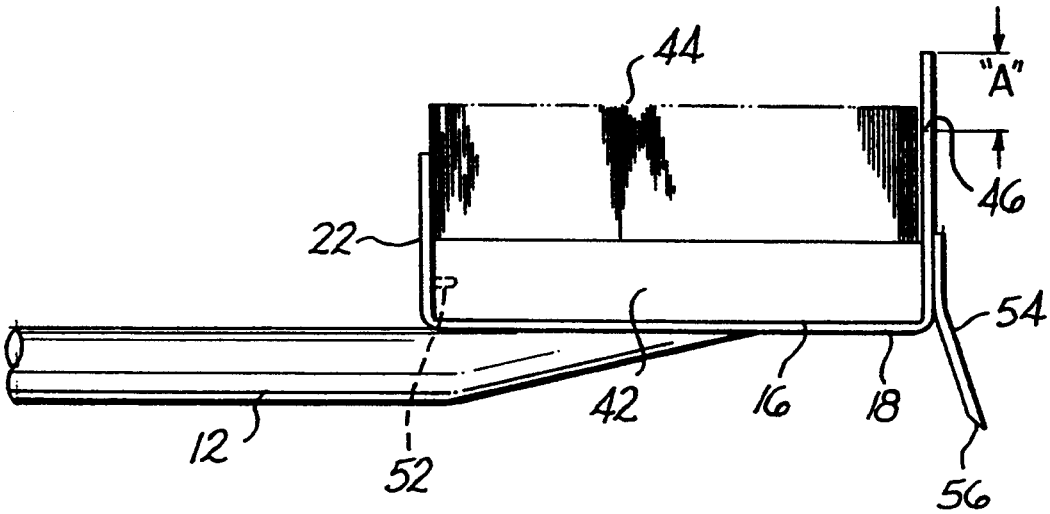
FIG. 2 is a partially fragmentary side elevational view of the preferred tool.

Referring to the drawings, a preferred tool 10 comprises an elongated rod-like handle 12. A plastic or wood grip 14 is mounted on the outer end of the handle for the user to grasp the tool. A channel-shaped scraper body 16 or holder is attached, as by welding, to the end of handle 12, as best illustrated in FIG. 2. Body 16 is formed of a metal sheet, such as stainless steel, about 1/16" thick and includes a generally flat base 18, a front scraper wall 20 which extends generally perpendicular to the front side of the base, and a rear wall 22 that is generally parallel to the front wall. Handle 12 is attached to the mid-section of base 18.

Front wall 20 has a uniform height along one side of the base, a width of 3' and includes a linear top edge 24 interrupted with four cut-out scraper openings 26, 28, 30 and 32. The openings are identical and each is elongated in a direction parallel to top edge 24. Each opening has a width of 7/16" adapted to receive conventional grill bars 34, 36, 38 and 40. Each opening has a depth from the linear edge to the bottom of the opening of 174", as illustrated at "A" in FIG. 2. Rear wall 22 is shorter than the front wall. Preferably, the front wall has a height of 1 1/16" . The rear wall has a height of ¾. As best illustrated in FIG. 2, the rear wall is parallel to the front wall to form a channel shaped holder The base has a width between its side edges of 3", and a distance between front and rear walls of 1 ⅞".

A bristle brush having a rectangular plastic body 42 is mounted between the front and rear walls. The brush has metal cleaning brass wire bristles standing 1" above base 18. A plane 44 containing the outer tips of the bristles is disposed between the two walls, but immediately behind the scraper openings. Preferably, the plane of the bristle tips is ⅛" above the bottom edge 46 of each of the scraper openings and perpendicular to the front wall. The bristle tips extend above the shorter rear wall.

A socket head set screw 48 3/16" long is mounted in a threaded opening 50 in the rear wall and received in a small opening 52 in the body 42 to lock the brush in position.

Figure 1:
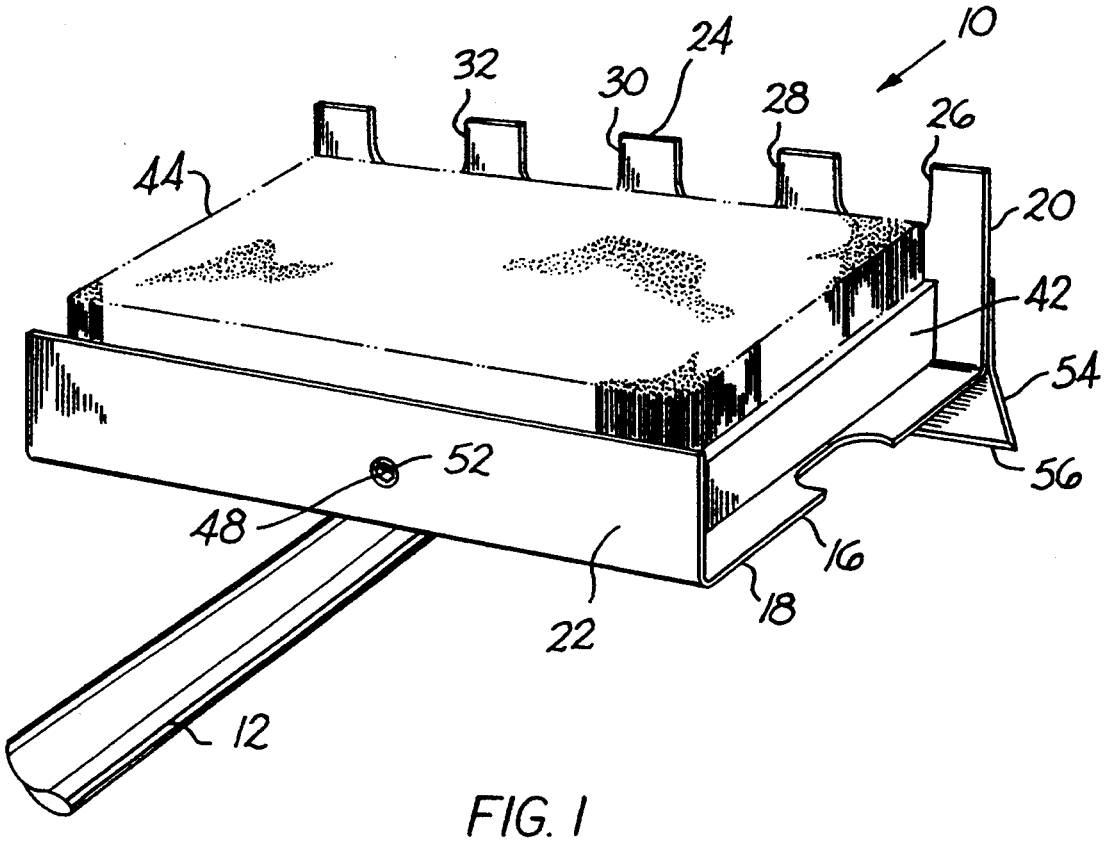
FIG. 1 is a perspective view of a cleaning tool illustrating the preferred embodiment of the invention.

A 1/16th" thick metal blade 54 having a linear beveled edge 56 is attached to the lower edge of front wall 20, as viewed in FIGS. 1 and 2. The blade extends the full width of wall 20 and extends about 178 " below the base 18. The blade is bent forward about 3/16" to assist the user in scraping a flat surface as he pushes on handle 12.

Figure 3:
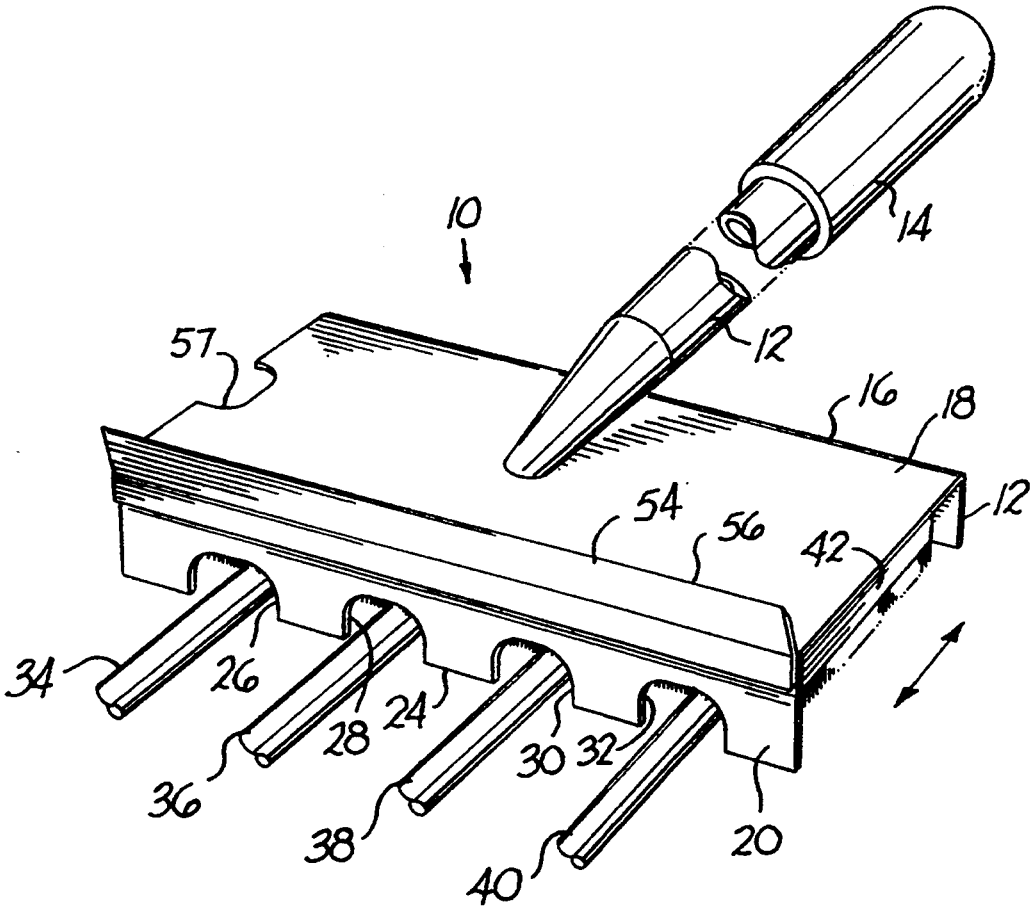
FIG. 3 is a view illustrating the manner in which the tool is employed for cleaning a grill.

In use, the tool is applied, as illustrated in FIG. 3, the scraper openings receiving the bars with the base of each opening contacting its respective bar. The tool is advanced along the length of the grill bars. As the tool is advanced along the bars, the scraper openings scrape the bulk of the burnt material from the top and sides of the bars. The wire brush bristles immediately behind the scraper openings remove the finer debris from the bars.

The brush is removable from the holder, either for cleaning or replacement.

Referring to FIG. 1, the side edge of the scraper body has another opening 57, identical in configuration to opening 26, in order to clean an individual bar.

Figure 4:
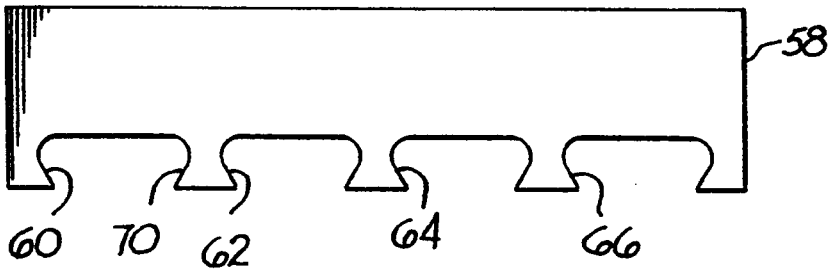
FIGS. 4 and 5 illustrate other embodiments of the scraper edge.

FIG. 4 illustrates an alternative scraper wall 58 having four scraper openings 60, 62, 64 and 66. The purpose of this illustration is to show an alternative configuration for the scraper openings in which the ends of each opening, as at 70, form a more acute angle with linear edge 24 as opposed to the embodiment of FIG. 1.

Figure 5:
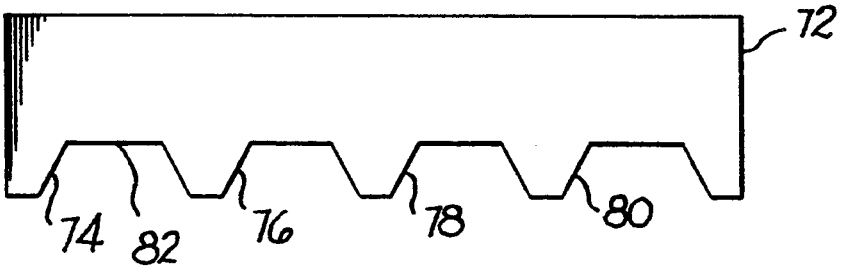

FIG. 5 illustrates another alternative scraper wall 72, having openings 74, 76, 78 and 80. The bottom of each opening as at 82, is linear and parallel to the top linear edge. The ends of each opening are tapered down from the outer linear edge to the bottom of the openings. Other configurations are possible for effectively scraping the burnt material from the grill bars.

Having described our invention, we claim:

1. A tool for scraping a grill having a plurality of spaced, parallel bars, comprising:

a handle;

a front, planar scraper wall mounted on the handle, the front scraper wall having an elongated top scraper edge interrupted by a plurality of similarly-shaped scraper openings spaced a distance corresponding to the distance between the parallel bars on the grill, the scraper openings being sized to slidably receive the grill bars, and each opening having a depth from said top scraper edge to the bottom of the opening;

a wire brush mounted on the handle, the brush having a plurality of wire bristles having tips generally disposed in a plane extending between the bottom of the scraper openings and the top edge of said front scraper wall, said plane being disposed generally adjacent to and at right angles to the plane of the front scraper wall.

2. A tool as defined in claim 1, including a rear wall carried by the handle and disposed generally parallel to the front scraper wall, the brush being removably disposed between the rear wall and the front scraper wall.

3. A tool as defined in claim 2, in which the rear wall has a top edge, and the plane of the bristle tips extends above the top edge of the rear wall.

4. A tool as defined in claim 1, including a generally U-shaped body attached to the handle, the body having a pair of spaced walls, including said front scraper and a second wall disposed rearwardly of the front wall and including said wire brush removably mounted between the front scraper wall and the rear wall.

5. A tool as defined in claim 1, in which the plane of the bristle tips is disposed adjacent the front scraper wall and about 1/16" above the bottom of the scraper openings in the scraper wall.

6. A tool as defined in claim 1, in which the openings are elongated in the direction of the length of the top scraper edge.

7. A tool as defined in claim 6, in which the scraper openings have rounded ends.

8. A tool as defined in claim 6, in which the scraper openings have a linear bottom parallel to the top edge.

9. A tool for scraping a grill having a plurality of spaced bars, comprising:

a handle;

a generally channel-shaped scraper body attached to the handle, the channel-shaped body having a front scraper wall with a generally linear scraper edge interrupted by a plurality of similarly-shaped scraper openings, the scraper openings being spaced a distance corresponding to the distance between the parallel bars in the grill, the scraper openings being sized to slidably receive the grill bars;

the scraper body having a rear wall; and a bristle body removably mounted between the front scraper wall and the rear wall, the bristle body having bristles mounted so as to be disposed adjacent and behind the scraper openings.

10. A tool as defined in claim 9, including a blade attached to the front scraper wall, the blade having a linear edge suited for scraping a flat surface.

* * * * *